US005569094A

United States Patent [19]

Macaluso

[11] Patent Number: 5,569,094

[45] Date of Patent: Oct. 29, 1996

[54] GOLF PRACTICE NET

[76] Inventor: Anthony G. Macaluso, 2805 Albany Ave., Davis, Calif. 95616

[21] Appl. No.: 611,902

[22] Filed: Mar. 6, 1996

[51] Int. Cl.[6] ..... A63B 63/00

[52] U.S. Cl. ..... 473/197; 273/411; 273/400; 273/407

[58] Field of Search ..... 473/197, 194, 473/172, 162, 164, 410, 407; 273/398–402, 127 B, 411, 26 A, 29 A, 29 B, 81 F

[56] References Cited

U.S. PATENT DOCUMENTS

| | | | |
|---|---|---|---|
| 4,336,942 | 6/1982 | Warehime | 273/411 |
| 5,088,740 | 2/1992 | Peterson | 473/197 |
| 5,244,213 | 9/1993 | Armell | 273/400 |
| 5,269,527 | 12/1993 | Noval | 473/197 |
| 5,427,381 | 6/1995 | Macaluso et al. | 273/400 |
| 5,433,433 | 7/1995 | Armell | 273/400 |

*Primary Examiner*—Mark S. Graham

*Attorney, Agent, or Firm*—Lynn & Lynn

[57] ABSTRACT

A portable net has an erected configuration for practicing golf or the like by stopping the flight of a golf ball and returning it to a selected location and a folded configuration for storage or transport. The portable net has an elastic frame that forms a base and a net support section. A net is connected to the net support section of the frame so that the net is extends away from the base in the erected configuration. The net is arranged to stop the flight of a golf ball that is incident thereon. A fabric is connected between the net and the base so that a projectile that has impinged upon the net falls to the fabric and then rolls to the front portion of the portable net. The frame is configured such that a person may put the frame into a folded configuration by deforming the first and second frame members into a plurality of generally concentric rings. A retainer such as a strap is provided for selectively retaining the frame in the folded configuration. The frame is formed such that elastic forces in the frame spontaneously move the frame to the erected configuration when the retainer is not engaged to retain the frame in the storage configuration.

10 Claims, 3 Drawing Sheets

GOLF PRACTICE NET

BACKGROUND OF THE INVENTION

This invention relates generally to apparatus and methods that allow a person to practice hitting or throwing a ball or the like in a confined space without having the ball travel a large distance or hit other persons or objects and cause injury or damage. Still more particularly, this invention relates to a net or the like for catching a golf ball that has been hit with a golf club and then returning the golf ball to its general location before it was hit with the golf club.

SUMMARY OF THE INVENTION

The golf practice net according to the invention has several advantages over the prior art. The invention catches the ball and returns it to the golfer and requires no anchors to keep in the desired location. The golf practice according to the invention net requires no assembly, is self-standing, easily collapsible for storage or transit and can be used indoors or outdoors.

A self-erecting portable net according to the invention has an erected configuration for practicing golf or the like by stopping the flight of a projectile such as a golf ball and returning it to a selected location and a folded configuration for storage or transport. The portable net comprises an elastic frame that includes a first frame member and a second frame member. The first frame member is arranged to have an upper frame portion and a lower frame portion, the lower frame portion and the second frame member cooperate to form a base that supports the portable net in a generally upright orientation on a generally horizontal surface when the portable net is in its erected configuration. The lower frame portion has an end that is spaced apart from the upper frame portion to form a front portion of the base, and the second frame member has an end that is spaced apart from the upper frame portion to form a rear portion of the base.

The portable net further comprises a first fabric section connected to the upper frame portion. The upper frame portion is arranged so that when the portable net is in its erected configuration, the upper frame portion extends upward away from the base with the first fabric section being arranged to stop a projectile that is incident thereon.

The portable net further comprises a second fabric section connected to the lower frame portion. The second fabric portion is arranged so that a projectile that has impinged upon the first fabric section falls to the second fabric section and then rolls to the front portion of the portable net. The frame is configured such that a person may put the frame into the folded position by deforming the first and second frame members into a plurality of generally concentric rings. A retainer such as a strap is provided for selectively retaining the frame in the folded configuration. The frame is formed such that elastic forces in the frame spontaneously move the frame to the erected configuration when the retainer is not engaged to retain the frame in the storage configuration.

In the self erecting portable net according to the invention, the first fame member comprises a first single loop and the second frame member comprises a second single loop. A pair of flexible cross straps may be connected between the upper frame and the second frame member with the pair of cross straps being arranged to maintain a selected angular spacing between the upper frame portion and the second frame member.

The self erecting portable net may further comprise a fabric band having a portion connected between the first fabric portion and the second fabric portion with a sleeve being formed in the fabric band. A portion of the second frame member is preferably formed to fit within the sleeve.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Figure 1:
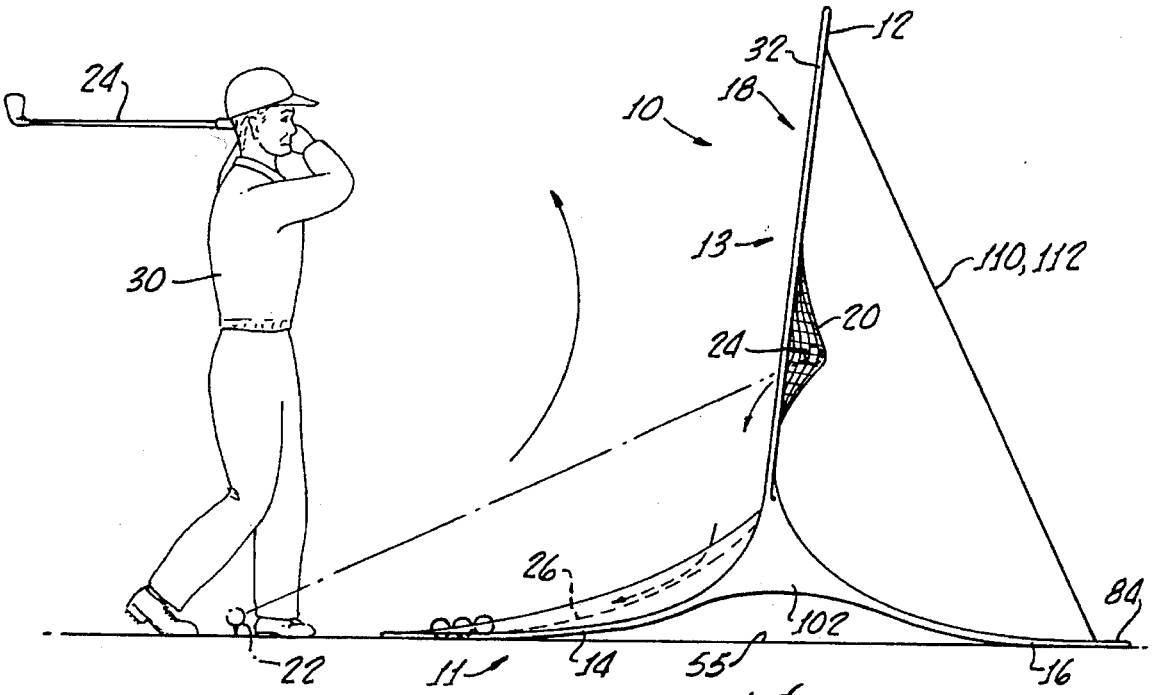
FIG. 1 illustrates a side of golf practice net according to the invention and shows a golf ball that has been stricken with a golf club being incident upon the net.
Figure 4:
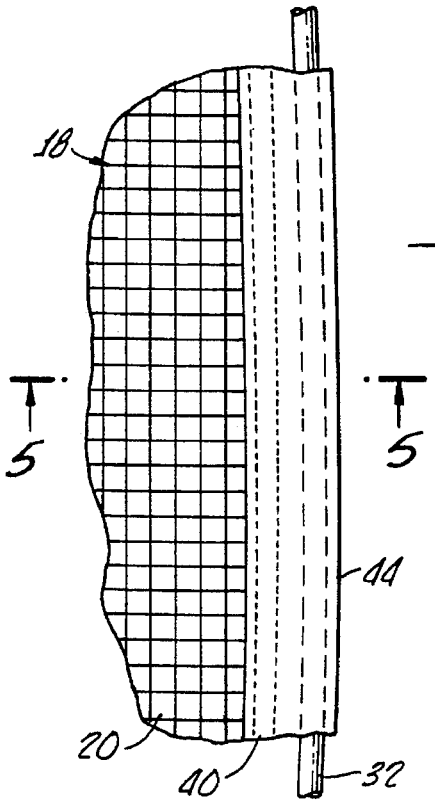
FIGS. 4 and 5 illustrate attachment of a portion of the net to the frame.
Figure 5:
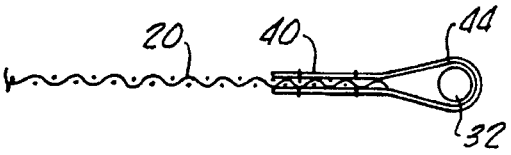

Referring to FIG. 1, a golf practice net 10 comprises a frame 12 that includes a pair of wire frame members 14 and 16. The wire frame members 14 and 16 are arranged to form a base 11 and a net support 13. A fabric 18 is connected to the frame members 14 and 16. The fabric 18 includes a first fabric section 20 that is arranged so that a golf ball 22 that has been stricken with a golf club 24 will impinge upon the first fabric section 20. The first fabric section 20 stops the flight of the golf ball 22, which then rolls down to a second fabric section 26. The second fabric section 26 is arranged to allow the golf ball 22 to roll back to near where the person 30 struck the golf ball 22 with the golf club 24.

The first fabric section 20 preferably is formed of netting or the like and is arranged to absorb the impact of the golf ball 22, which may be traveling at a velocity typical for a golf ball that has been stricken with a golf club such as an iron or a driver. The first fabric section 20 absorbs the impact so that the golf ball 24 has no appreciable recoil velocity after it hits the first fabric section 20.

Figure 2:
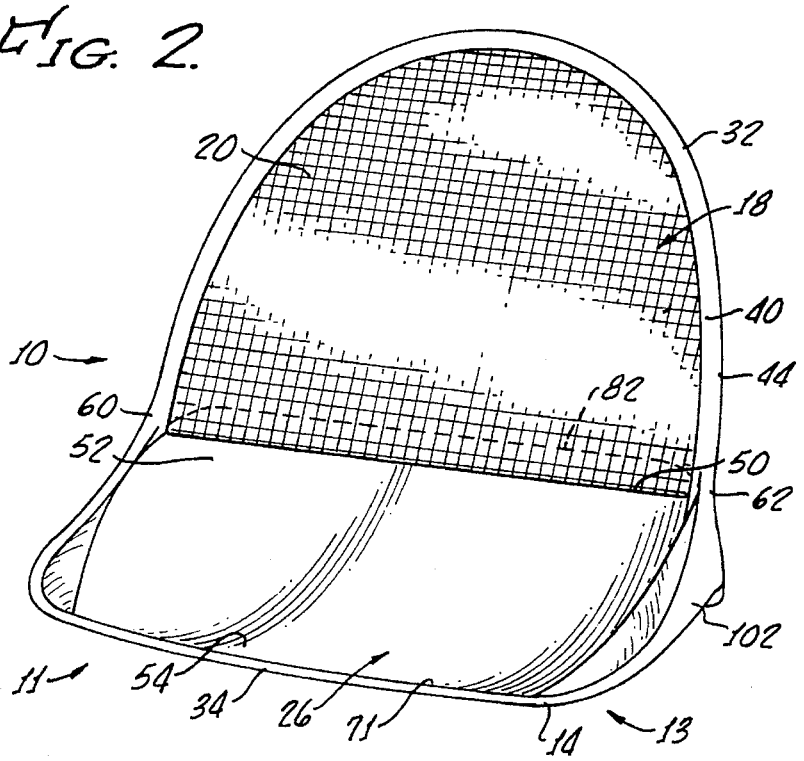
FIG. 2 is a front perspective view showing a frame and net structure that may be included in the present invention.
Figure 3:
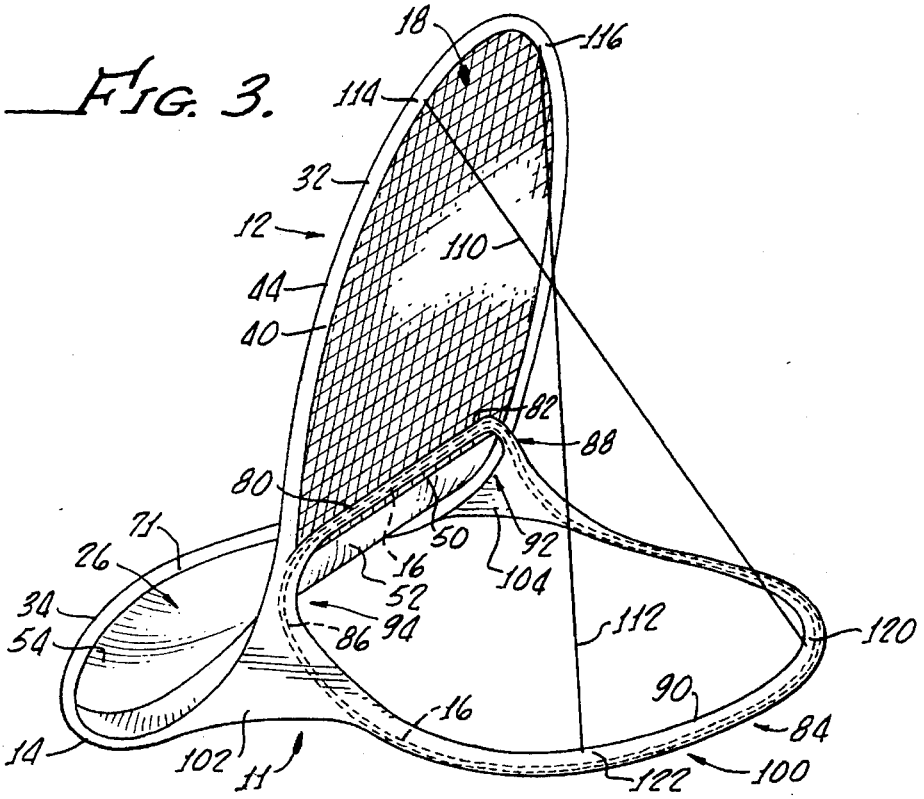
FIG. 3 is a rear perspective view of the apparatus of FIG. 2.

The frame members 14 and 16 are formed of a flexible material that has a memory for the erected configuration of FIGS. 1–3. Steel spring wire is a suitable material for forming the frame members 14 and 16. The ends of the wire frame member 14 preferably are connected together by any convenient means so that the frame member 14 is a continuous loop. The ends of the frame member 16 preferably are also connected together to form a continuous loop.

The frame member 14 has an upper portion 32 and a lower portion 34. The upper frame portion 32 preferably is substantially upright when it is in the erected position of FIGS. 1–3. The upper section 32 of the frame member 14 is a net support section that supports the first fabric section 20. The second fabric section 26 is mounted to the lower portion 34. The first fabric section 20 is shown to have a curved peripheral band 40. The outer edge of the peripheral band 40 may include a continuous sleeve 44 formed around the periphery of the first fabric section 20 with the upper section 32 of the frame member 14 passing through the sleeve 44.

The frame member 16 and the portion of the frame member 14 that extends below the band 40 as shown in FIGS. 1–3 cooperate to form the base for the golf practice net 10. Therefore, the golf practice net 10 according to the invention includes the base, the net support and the ball return section.

The upper fabric section 20 preferably is formed generally either as a half oval or a semicircle. The band 40 has a lower, substantially straight portion 50 that separates the upper fabric section 20 and the tower fabric section 26. The lower fabric section 26 has an upper end 52 connected to the straight band portion 50 and a lower portion 54 that extends to the generally horizontal surface 55, such the earth, upon which the golf practice net 10 rests when in use. The straight band portion 50 is preferably about a foot or two above the horizontal surface 55. The frame member 14 preferably is formed such that the lower end 54 of the second fabric section 26 is displaced a few feet laterally from the band 50. Therefore, the second fabric section 26 preferably is inclined at a shallow angle from the horizontal.

The lower fabric section 26 has upper ends 60 and 62 that are mounted to the frame member 14 a few inches above the horizontal band portion 50. The lower end 54 of the lower fabric section 26 is mounted to the frame member 14 by any suitable means such as a sleeve 71 or by a plurality of straps (not shown). The lower fabric section 26 may be under tension and is preferably arranged to have a shape that directs the golf ball 22 back to the golfer 30. As illustrated, the arrangement of the upper ends 60 and 62 and the lower end 54 is such that the lower fabric section 26 has a substantially concave shape. After the golf ball 22 strikes the upper fabric portion 20, it then rolls down to the lower fabric section 26. The concave shape of the lower fabric section 26 directs the golf ball 22 in the general direction of the golfer 30. Therefore, the lower portion of the frame member 14 and the fabric 26 form a ball return section.

The frame member 16 has a substantially straight section 80 that passes through a sleeve 82 in the straight band portion 50 and then extends to the rear of the golf practice net 10. The frame member 16 has a curved portion 84 that extends between the ends 86 and 88 of the straight section 80. A fabric band 90 has its ends 92 and 94 connected to the band 50. The curved portion of the frame member 16 passes through a plurality of loops 100 connected to the band 90. Alternatively, instead of the loops 100, the curved portion 80 of the frame member may pass through a sleeve (not shown).

The ends of the band 50 are connected to the first frame member 14. Therefore, near the ends of the band 50, the frame members 14 and 16 have portions near the upper end of the second fabric section 26 that are spaced apart by only a small distance. A pair of fabric webbings 102 and 104 extend between the first frame member 14 and the second frame member 16. Although the portions of the frame members 14 and 16 that are close together are curved, the webbings 102 and 104 are approximately triangular in shape. The height of the webbings 102 and 104 are such that when the golf practice net 10 is erected, the webbings are substantially vertical and extend from the band 50 to a location near the ground. The frame section 16 is also preferably formed as a continuous loop of a flexible material that has a memory for the configuration illustrated in FIGS. 1–3 when the golf practice net is erected.

Referring to FIGS. 1 and 3, the golf practice net 10 preferably includes a pair of straps 110 and 112 that extend from upper portions 114 and 116 on the sleeve 44 to locations 118 and 120 on the fabric band 90 near the rear edge of the curved portion 84 of the frame member 16. The straps 110 and 112 preferably cross one another to make a generally "X" configuration. The straps 110 and 112 may be formed of heavy twine, rope, wire, etc.

The golf practice net 10 may be folded for storage as shown in FIGS. 6A–6E. Because of the memory of the frame members 14 and 16 for the erected configuration, unless it is constrained, the spring forces in the frame members 14 and 16 will cause the golf practice net 10 to spontaneously assume the erected configuration. Therefore, the golf practice net is self-erecting if the frame is not constrained to some other configuration.

Figure 6A:
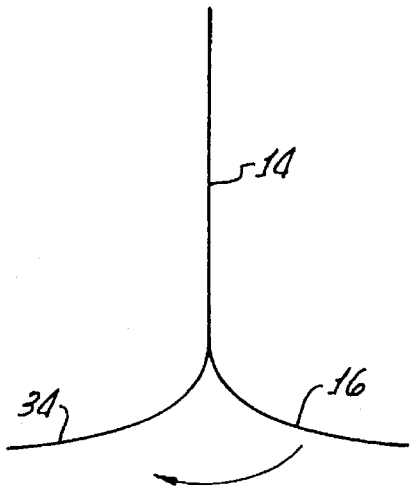
FIGS. 6A–6F illustrates steps involved in folding the golf practice net according to the invention for storage.
Figure 6B:
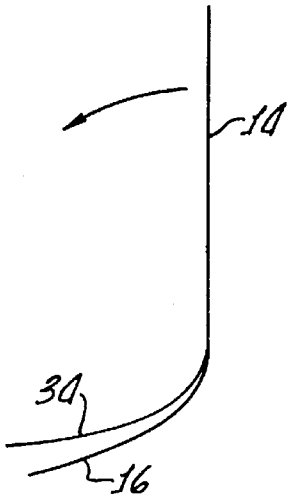
Figure 6C:
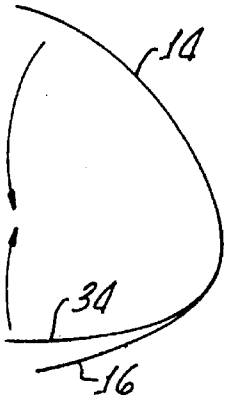
Figure 6D:
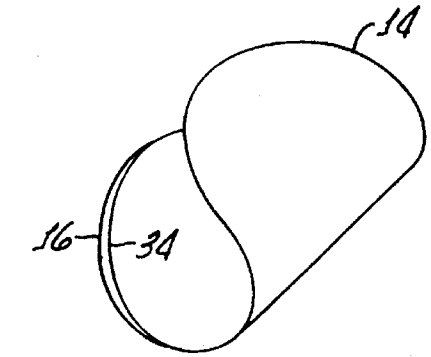
Figure 6E:
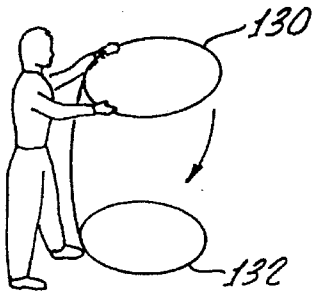
Figure 6F:
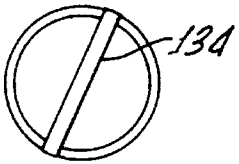

Referring to FIG. 6A, the first step in folding the golf practice net 10 for storage is to pull the rear leg, comprising the frame member 16 toward the lower portion 34 of the upper frame member 14 so that they are substantially adjacent. Referring to FIGS. 6B and 6C, the upper portion 32 of the frame member 14 is then pulled downward so that it bends about its central portion, which is near the straight portion of the frame member 16. Referring to FIG. 6D, alter the end of the frame member 16 and the upper and lower edges of the frame member 14 are pulled close together, the sides of the frame members are pulled together so that the golf practice net 10 is shaped generally as "taco shell." Referring to FIG. 6E, the folding process continues by twisting the frame members 14 and 16 to form a pair of loops 130 and 132, which may be then held close together and secured by a strap 134 or the like as shown in FIG. 6F. The frame members 14 and 16 then are coiled up in a compact configuration suitable for storage or transport.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

The foregoing detailed description is to be clearly understood as given by way of illustration and example only, the spirit and scope of this invention being limited solely by the appended claims.

What is claimed is:

1. A self-erecting portable net that has an erected configuration for practicing golf by stopping the flight of a projectile such as a golf ball and returning it to a selected location and a folded configuration for storage or transport, comprising:

an elastic frame that includes a first frame member and a second frame member, the first frame member being arranged to have an upper frame portion and a lower frame portion, the lower frame portion and the second frame member cooperating to form a base that supports the portable net in a generally upright orientation on a generally horizontal surface when the portable net is in its erected configuration, the lower frame portion having an end that is spaced apart from the upper frame portion to form a front portion of the base, the second frame member having and end that is spaced apart from the upper frame portion to form a rear portion of the base;

a first fabric section connected to the upper frame portion, the upper frame portion being arranged so that when the portable net is in its erected configuration, the upper frame portion extends upward away from the base, the first fabric section being arranged to stop a projectile that is incident thereon;

a second fabric section connected to the lower frame portion, the second fabric portion being arranged so that a projectile that has impinged upon the first fabric section falls to the second fabric section and then rolls to the front portion of the portable net;

the frame being configured such that a person may put the frame into the folded position by deforming the first and second frame members into a plurality of generally concentric rings; and a retainer for selectively retaining the frame in the folded configuration, the frame being formed such that elastic forces in the frame spontaneously move the frame to the erected configuration when the retainer is not engaged to retain the frame in the storage configuration.

2. The self erecting portable net of claim 1 wherein the first frame member comprises a first single loop and wherein the second frame member comprises a second single loop.

3. The self erecting portable net of claim 1, further comprising a pair of flexible cross straps connected between the upper frame portion and the second frame member, the pair of cross straps being arranged to maintain a selected angular spacing between the upper frame portion and the second frame member.

4. The self erecting portable net of claim 1, further comprising:

a fabric band having a portion connected between the first fabric portion and the second fabric portion;

a sleeve formed in the fabric band; and a portion of the second frame member formed to fit within the sleeve.

5. The self erecting portable net of claim 4, further comprising a fabric webbing connected between a portion of the lower frame portion and the second frame member.

6. A method for forming a self-erecting portable net that has an erected configuration for practicing golf by stopping the flight of a projectile such as a golf ball and returning it to a selected location and a folded configuration for storage or transport, comprising:

forming an elastic frame to include a first frame member and a second frame member;

arranging the first frame member to have an upper frame portion and a lower frame portion that cooperate to form a base that supports the portable net in a generally upright orientation on a generally horizontal surface when the portable net is in its erected configuration;

arranging the lower frame portion to have an end that is spaced apart from the upper frame portion to form a front portion of the base;

arranging the second frame member to have and end that is spaced apart from the upper frame portion to form a rear portion of the base;

connecting a first fabric section to the upper frame portion;

arranging the upper frame portion so that when the portable net is in its erected configuration, the upper frame portion extends upward away from the base;

arranging the first fabric section to stop a projectile that is incident thereon;

connecting a second fabric section to the lower frame portion;

arranging the second fabric portion so that a projectile that has impinged upon the first fabric section falls to the second fabric section and then rolls to the front portion of the portable net;

forming the frame such that a person may put the frame into the folded position by deforming the first and second frame members into a plurality of generally concentric rings;

providing a retainer for selectively retaining the frame in the folded configuration; and forming the frame such that elastic forces in the frame spontaneously move the frame to the erected configuration when the retainer is not engaged to retain the frame in the storage configuration.

7. The method of claim 6 including the steps of forming the first frame member to comprise a first single loop and forming the second frame member to comprise a second single loop.

8. The method of claim 6, further comprising the steps of connecting a pair of flexible cross straps between the upper frame portion and the second frame member and arranging the pair of cross straps to maintain a selected angular spacing between the upper frame portion and the second frame member.

9. The method of claim 6, further comprising the steps of:

connecting a fabric band having a portion between the first fabric portion and the second fabric portion;

forming a sleeve in the fabric band; and forming a portion of the second frame member to fit within the sleeve.

10. The method of claim 9, further comprising the step of connecting a fabric webbing between a portion of the lower frame portion and the second frame member.

* * * * *